US006481234B2

(12) United States Patent
Ma et al.

(10) Patent No.: US 6,481,234 B2
(45) Date of Patent: Nov. 19, 2002

(54) HEAT PUMP SYSTEM FOR AIR CONDITIONING ADAPTABLE TO COLD REGIONS

(75) Inventors: Guoyuan Ma, Beijing (CN); Qisen Yan, Beijing (CN); Yi Jiang, Beijing (CN)

(73) Assignee: Tsinghua University, Beijing (CN)

( * ) Notice: Subject to any disclaimer, the term of this patent is extended or adjusted under 35 U.S.C. 154(b) by 0 days.

(21) Appl. No.: 09/865,038

(22) Filed: May 24, 2001

(65) Prior Publication Data

US 2002/0129615 A1 Sep. 19, 2002

(30) Foreign Application Priority Data

Mar. 14, 2001 (CN) ..... 01109633 A

(51) Int. Cl.[7] ..... F25B 13/00

(52) U.S. Cl. ..... 62/324.1; 62/160; 62/328.7; 62/260; 62/196.4

(58) Field of Search ..... 62/324.1, 160, 62/328.7, 260, 196.4

(56) References Cited

U.S. PATENT DOCUMENTS 5,669,224 A * 9/1997 Lenarduzzi ..... 62/160
5,701,753 A * 12/1997 Iritani ..... 62/211
5,848,537 A * 12/1998 Biancardi et al. ..... 62/324.6
5,927,088 A * 7/1999 Shaw ..... 62/175
5,937,670 A * 8/1999 Derryberry ..... 62/324.4
6,035,653 A * 3/2000 Itoh et al. ..... 62/228.4
6,038,875 A * 3/2000 Haselden ..... 62/218
6,070,420 A * 7/2000 Biancardi et al. ..... 62/114
6,237,681 B1 * 5/2001 Takano et al. ..... 165/241
6,253,564 B1 * 7/2001 Yarbrough et al. ..... 62/238.7

OTHER PUBLICATIONS

Article entitled "Development of Packaged Air Conditioners for Cold Region", by N. Horiuchi, pp. 45–49, Jul. 1997, (copy of partial English translation).
Article entitled "Development of Burner for Room Air Conditioner", pp. 96–99, 1998, (copy of partial English translation).

* cited by examiner

*Primary Examiner*—William C. Doerrler
*Assistant Examiner*—Mark Shulman
(74) *Attorney, Agent, or Firm*—Westman, Champlin & Kelly, P.A.

(57) ABSTRACT

A heat pump system for air conditioning adaptable to cold regions, comprising a compressor, a condenser, a thermal expansion valve and an evaporator and forms a closed circuit. The structure features that said compressor is a scroll compressor, and a supplementary inlet is provided on the working chamber of the compressor. A subcooler is provided between the condenser and the expansion valve, thus forming a closed circuit with an electromagnetic valve and an electronic expansion valve for supplementary refrigerant vapor to the supplementary inlet of the compressor. Compared to the prior art, the present invention is simple in structure, easy to manufacture and assemble, highly effective in energy utilization and low cost, and the system can operate in low temperature environment with stability and reliability. Therefore, it is particularly suitable for popularization and application in cold regions.

2 Claims, 1 Drawing Sheet

HEAT PUMP SYSTEM FOR AIR CONDITIONING ADAPTABLE TO COLD REGIONS

Figure 1:
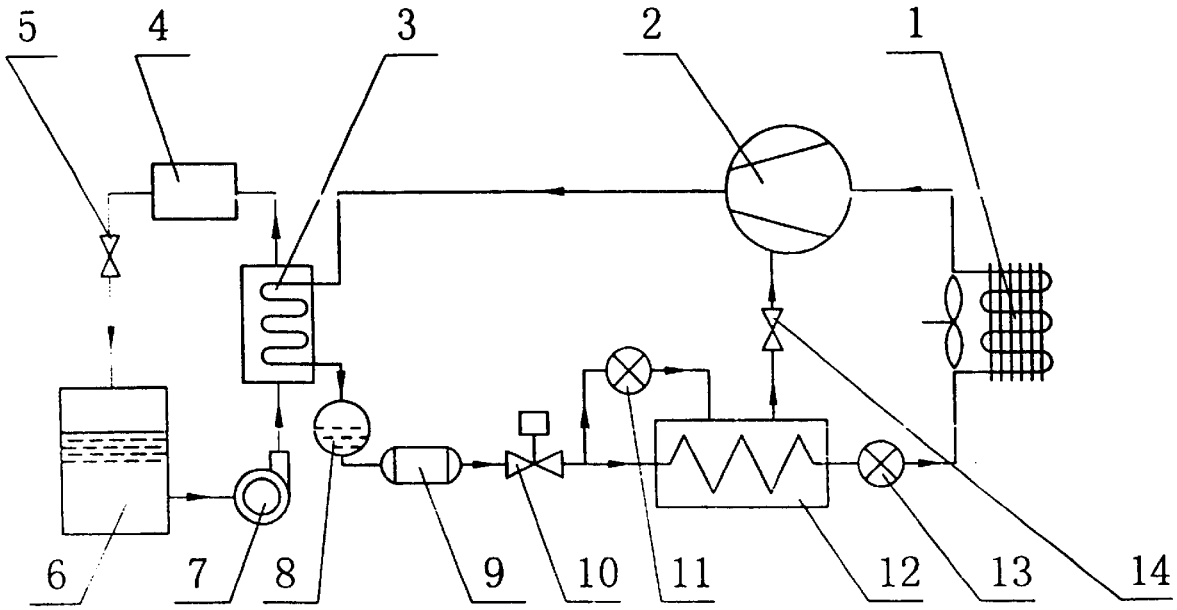

The present application claims priority of Chinese patent application Serial No. 01109633.0, filed Mar. 14, 2001, the content of which is hereby incorporated by reference in its entirety.

BACKGROUND OF THE INVENTION

1. Field of the Invention

The present invention relates to a heat pump system for air conditioning and, more particularly, to a heat pump system for air conditioning adaptable to cold regions.

2. Description of Related Art

A heat pump for air conditioning has been used widely in the world. It can meet the heating requirements in winter with less consumption of energy. Because of its characteristics of convenient application, high energy utilization efficiency, and no pollutant generation, the heat pump for air conditioning should be the preferred electrical heating unit. However, when the outside temperature is below −5° C., the heating capacity and reliability of the conventional heat pump for air conditioning will decrease greatly, thus it can not meet the heating requirements in cold regions in winter. There have been known many proposals for the operation of heat pump for air conditioning with high efficiency, stability and reliability. In the prior art, a supplementary electric heater has been added to the indoor water pipe to resolve the problem of insufficient heat capacity. As disclosed in "Development of Packaged Air Conditioner For Cold Region" written by N.Horiuchi. and published in the Journal of Refrigeration in Japan, Vol.72, No. 7, Issue No.837, 1997, with a frequency conversion system used for the heat pump system, the refrigerant circulation volume is increased by operating the compressor at high frequency under low temperature conditions and refrigerant liquid is injected simultaneously into the working chamber of the compressor to prevent the chamber from being overheated. Additionally, a technical solution is disclosed in " Development of Burner for Room Air Conditioner" published in the Mitsubishi Heavy INC. Disclosing Bulletin in Japan, Vol.35, No.2, 1998, wherein the low temperature performance of the heat pump is improved by using kerosene burner to heat the outside heat exchanger under low temperature conditions. For the above mentioned solutions, it is necessary to provide additional equipment for the heat pump, resulting in complication of the system, an increase in cost and lower energy utilization efficiency, so the problems in the prior have not been resolved substantially.

SUMMARY OF THE INVENTION

To solve above-mentioned problems in the prior art, an object of the present invention is to provide a heat pump system for air conditioning adaptable to cold regions, which is simple in structure, low cost, easy to manufacture and assemble and highly effective in energy utilization.

According to the present invention, a heat pump system for air conditioning adaptable to cold regions comprises a compressor, a condenser, a thermal expansion valve and an evaporator, wherein the outlet of the compressor is connected with the refrigerant inlet of the condenser; the refrigerant outlet of the condenser is connected with a liquid receiver which is also connected with the inlet of a filter; the outlet of the filter is connected with the inlet of a subcooler through an electromagnetic valve; the outlet of the subcooler is connected with the inlet of the thermal expansion valve; the outlet of the thermal expansion valve is connected with the refrigerant inlet of the evaporator; the refrigerant outlet of the evaporator is connected with the inlet of the compressor. Either water circulation system or air circulation system can be applied to perform the heat exchange in the condenser, and the heat absorbed by water or air is released in a fan coil unit. This structure features that said compressor is a scroll compressor which is provided with a supplementary inlet on the working chamber thereof; the inlet of an additional expansion valve is connected with the joint between said electromagnetic valve and the inlet of a subcooler; the outlet of the additional expansion valve is connected with the supplementary inlet of the subcooler; and the supplementary outlet of the subcooler is connected with the supplementary inlet of the compressor through a shut-off valve.

With the above-described connections in accordance with the present invention, and there is provided a supplementary pipe paralleled to the main pipe between the condenser and the compressor for adding evaporated refrigerant to the compressor, heat exchange occurs between the two parts of refrigerant within the main pipe and the refrigerant within the supplementary pipe in the subcooler. So sufficient evaporated refrigerant can be injected into the working chamber of the compressor through the main inlet and the supplementary inlet under low temperature conditions. Thus the low operating temperature range of the unit is widened. According to the present invention, the heat pump system for air conditioning can operate with stability and reliability at −15° C. for a long term, further, the exhaust temperature is stable and does not go beyond the limit of 130° C., thus it can meet the heating requirements in cold regions perfectly. By comparison with the prior art, the unit only has an addition of an expansion valve so almost no other component except the expansion valve causes the increase of the cost of the unit. As described above, the heat pump system for air conditioning is simple in structure, low cost, easy to manufacture and assemble and highly effective in energy utilization. Thus it is particularly suitable for popularization and application in cold regions.

BRIEF DESCRIPTION OF THE ACCOMPANYING DRAWINGS

Further, description of the present invention will be given below accompanied with the drawings and the embodiments.

FIG. 1 is a schematic diagram showing a structure of the heat pump system in accordance with the present invention.

DETAILED DESCRIPTION OF THE INVENTION

As shown in FIG. 1 there is provided a heat pump system for air conditioning according to the present invention, comprising a compressor 2, a condenser 3, a thermal expansion valve 13 and an evaporator 1, wherein the compressor 2 is a scroll compressor and provided with a supplementary inlet on the working chamber thereof; and the outlet of the compressor 2 is connected with the refrigerant inlet of the condenser 3; the refrigerant outlet of the condenser 3 is connected with a refrigerant container 8 which is also connected with the inlet of a filter 9; the outlet of the filter 9 is connected with the inlets of a subcooler 12 and an electronic expansion valve 11, through an electromagnetic valve 10, the outlet of the electronic expansion valve 11 is connected with the supplementary inlet of the subocooler 12; the supplementary outlet of the subcooler 12 is connected with the supplementary inlet of the compressor 2 through a shut-off valve 14; the outlet of the subcooler 12 is connected with the inlet of the thermal expansion valve 13; the outlet of the thermal expansion valve 13 is connected with the refrigerant inlet of the evaporator 1; the refrigerant outlet of the evaporator 1 is connected with the inlet of the compressor 2. The heat exchange in said condenser is accomplished in such a manner that the cooling water is injected into the condenser 3 by a water pump 7, and the heat absorbed by the water is released by a fan coil unit 4, then the water enters a water tank 6 through a control valve 5. The water tank 6 is connected with the water pump 7, thus forming a closed circuit. Additionally, heat exchange in the condenser 3 can be accomplished by air circulation system applied in the prior art, and the description of which is omitted here.

When the heat pump system for air conditioning according to the present invention is operated, the refrigerant vapor at high temperature and high pressure discharged by the compressor 2 with a supplementary inlet is transformed into liquid refrigerant after exchanging heat with water or air in the condenser 3 and transmitting the heat to the water or air, and the water or air releases the absorbed heat in the fan coil unit 4. The high pressure liquid refrigerant from the condenser 3 passes through the liquid receiver 8 and the desiccation filter 9 subsequently to the electromagnetic valve 10, then the refrigerant pipe is divided into two ways by the electromagnetic valve 10: the main pipe used for the main refrigeration cycle and the supplementary pipe used for supplementing refrigerant vapor. The refrigerant within the main pipe enters the subcooler 12, at the same time, the liquid refrigerant within the supplementary pipe becomes low pressure tow-phase refrigerant after being depressurized by the electronic valve 11, and then enters the subcooler 12. After heat exchange between the tow parts of refrigerant in the subcooler 12, the liquid refrigerant within the supplementary pipe becomes refrigerant vapor and then be sucked into the compressor 2 through the supplementary inlet thereof. On the other hand, the refrigerant within the main pipe becomes sub-cooled liquid refrigerant and then enters evaporator 1 after being depressurized by the thermal expansion valve 13. In the evaporator 1, the refrigerant within the main pipe absorbs the heat from the low temperature atmosphere thus becomes low temperature refrigerant vapor, then be sucked into the compressor 2 through the inlet. The refrigerant from the main pipe is mixed with the refrigerant from the supplementary pipe in the compressor 2, then the mixture is further compressed and discharged, thus the closed operating circuit is formed.

What is claimed is:

1. A heat pump system for air conditioning adaptable to cold regions comprising: a compressor, a condenser, a thermal expansion valve, and an evaporator, wherein the outlet of the compressor is connected with the refrigerant inlet of the condenser, and the refrigerant outlet of the condenser is connected with a liquid receiver which is also connected with the inlet of a filter, and the outlet of the filter is connected with the inlet of a subcooler through an electromagnetic valve, and the outlet of the subcooler is connected with the inlet of the thermal expansion valve, and the outlet of the thermal expansion valve is connected with the refrigerant inlet of the evaporator, and the refrigerant outlet of the evaporator is connected with the inlet of the compressor, and the heat exchange in the condenser is accomplished by using water circulation system or air circulation system, and the heat absorbed by the water or air is released by a fan coil unit, characterized in that: said compressor is a scroll compressor, and a supplementary inlet is provided on the working chamber of the scroll compressor; the inlet of an additional expansion valve is connected with the joint between said electromagnetic valve and the inlet of said subcooler; the outlet of the expansion valve is connected with the supplementary inlet of the subcooler; the supplementary outlet of the subcooler is connected with the supplementary inlet of the compressor through a shut-off valve.

2. The heat pump system for air conditioning adaptable to cold regions of claim 1, characterized in that: said expansion valve is an electronic expansion valve.

* * * * *

UNITED STATES PATENT AND TRADEMARK OFFICE

CERTIFICATE OF CORRECTION

PATENT NO. : 6,481,234 B2
DATED : November 19, 2002
INVENTOR(S) : Guoyuan Ma et al.

It is certified that error appears in the above-identified patent and that said Letters Patent is hereby corrected as shown below:

Title page,
Item [73], Assignee, add the following:
-- Tsinghua Tongfang Co., Ltd., Beijing, (CN) --

Signed and Sealed this

Twentieth Day of May, 2003

JAMES E. ROGAN
*Director of the United States Patent and Trademark Office*